US008210409B2

(12) United States Patent
Hirabayashi

(10) Patent No.: US 8,210,409 B2
(45) Date of Patent: Jul. 3, 2012

(54) DRIVING TOOL

(75) Inventor: Shinji Hirabayashi, Anjo (JP)

(73) Assignee: Makita Corporation, Anjo (JP)

( * ) Notice: Subject to any disclaimer, the term of this patent is extended or adjusted under 35 U.S.C. 154(b) by 256 days.

(21) Appl. No.: 12/675,017

(22) PCT Filed: Aug. 27, 2008

(86) PCT No.: PCT/JP2008/065325

§ 371 (c)(1),
(2), (4) Date: Apr. 26, 2010

(87) PCT Pub. No.: WO2009/028565

PCT Pub. Date: Mar. 5, 2009

(65) Prior Publication Data

US 2011/0094847 A1 Apr. 28, 2011

(30) Foreign Application Priority Data

Aug. 27, 2007 (JP) ..... 2007-219711

(51) Int. Cl.
*B25C 5/06* (2006.01)

(52) U.S. Cl. ..... 227/131; 227/2; 227/133

(58) Field of Classification Search ..... 227/2, 130, 227/131, 132, 133, 129, 8; 173/124, 205, 173/178

See application file for complete search history.

(56) References Cited

U.S. PATENT DOCUMENTS

| | | | | |
|---|---|---|---|---|
| 4,161,272 | A | 7/1979 | Brockl | |
| 4,583,600 | A * | 4/1986 | Smith, III | 173/124 |
| 5,320,270 | A * | 6/1994 | Crutcher | 227/131 |
| 5,511,715 | A * | 4/1996 | Crutcher et al. | 227/131 |
| 6,669,072 | B2 * | 12/2003 | Burke et al. | 227/131 |
| 6,766,935 | B2 * | 7/2004 | Pedicini et al. | 227/131 |
| 6,971,567 | B1 * | 12/2005 | Cannaliato et al. | 227/2 |
| 7,138,595 | B2 * | 11/2006 | Berry et al. | 200/522 |
| 7,334,715 | B2 * | 2/2008 | Oda et al. | 227/2 |
| 7,575,141 | B1 * | 8/2009 | Liang et al. | 227/131 |
| 7,832,610 | B2 * | 11/2010 | Tanimoto et al. | 227/132 |
| 7,934,565 | B2 * | 5/2011 | Krondorfer et al. | 173/1 |
| 2006/0261125 | A1 | 11/2006 | Schiestl | |
| 2006/0283910 | A1 | 12/2006 | Schiestl et al. | |

FOREIGN PATENT DOCUMENTS

JP A 53-87078 8/1978

(Continued)

OTHER PUBLICATIONS

International Search Report issued in corresponding International Application No. PCT/JP2008/065325, mailed Sep. 30, 2008. (with English-language translation).

*Primary Examiner* — Scott A. Smith
(74) *Attorney, Agent, or Firm* — Oliff & Berridge, PLC

(57) ABSTRACT

A driving tool of the invention includes a motor, a flywheel that is rotationally driven by the motor, an operating member that drives a material to be driven, an operating member actuation mechanism that selectively transmits a rotating force of the flywheel to the operating member and drives the operating member. The flywheel includes a driving-side member that is rotationally driven by the motor, a driven-side member that transmits a rotating force to the operating member, and a clutch member that connects the driving-side member and the driven-side member when the rotation speed of the motor is a predetermined speed or higher, while releasing the connection between the driving-side member and the driven-side member when the rotation speed of the motor is lower than the predetermined speed.

4 Claims, 5 Drawing Sheets

FOREIGN PATENT DOCUMENTS

| | | |
|---|---|---|
| JP | A 6-179178 | 6/1994 |
| JP | A 2003-184957 | 7/2003 |
| JP | A 2006-026858 | 2/2006 |
| JP | A 2006-326828 | 12/2006 |
| JP | A 2006-346855 | 12/2006 |
| JP | A 2007-136598 | 6/2007 |

* cited by examiner

DRIVING TOOL

FIELD OF THE INVENTION

The invention relates to a driving tool that drives a material to be driven such as a nail by driving an operating member via a flywheel.

BACKGROUND OF THE INVENTION

Japanese non-examined laid-open patent publication H06-179178A discloses a flywheel-type driving tool. The known driving tool uses a flywheel to drive an operating member. The driver contacts the outer circumferential surface of the flywheel which is rotationally driven at high speed by an electric motor so that the driver is linearly driven and strikes a material to be driven.

When the rotation speed of the electric motor is not increased to a predetermined speed due to a drop of supply voltage to drive the electric motor (for example, a voltage drop of a battery) and as a result, shortage of the inertial energy of the flywheel is caused, faulty driving operation may possibly take place.

SUMMARY OF THE INVENTION

Accordingly, it is an object of the invention to prevent faulty driving of a material to be driven which may be caused by inadequate rotation speed of a motor in a driving tool.

Above-described object can be achieved by a claimed invention. According to a representative embodiment of the invention, a driving tool includes a motor, a flywheel that is rotationally driven by the motor, an operating member that drives a material to be driven, an operating member actuation mechanism that selectively transmits a rotating force of the flywheel to the operating member and drives the operating member. The "material to be driven" according to the invention typically represents a nail, a staple and so on.

According to the invention, the flywheel includes a driving-side member that is rotationally driven by the motor, a driven-side member that transmits a rotating force to the operating member, and a clutch member that connects the driving-side member and the driven-side member when the rotation speed of the motor is a predetermined speed or higher, while releasing the connection between the driving-side member and the driven-side member when the rotation speed of the motor is lower than the predetermined speed. Further, as the "clutch member" according to the invention, typically, a centrifugal clutch that connects the driving-side member and the driven-side member by utilizing the centrifugal force generated by rotation is suitably used.

According to the invention, during rotation of the motor, connection between the driving-side member and the driven-side member is released or such connection is not effected when the rotation speed of the motor is lower than the predetermined speed. Therefore, for example, when the supply voltage to the motor is lower than a predetermined voltage so that the inertial energy of the flywheel which is required for driving a material to be driven cannot be secured, the operation of driving the material to be driven in the state of the energy shortage can be avoided. Thus, faulty driving of the material to be driven can be prevented.

Further, according to the invention, with the construction in which the driving-side member and the driven-side member are connected when the rotation speed of the motor reaches a predetermined speed, a slight time lag can be created between the starting time of the driving motor and the time of rotation of the flywheel (the time of connection of the driving-side member and the driven-side member by the clutch member). Therefore, the maximum starting current at the time of starting the driving motor can be minimized. As a result, for example, in the case of a battery-powered driving tool in which the motor is driven by a battery, decrease of the battery life can be prevented.

According to the invention, an effective technique is provided for preventing faulty driving of a material to be driven which may be caused by inadequate rotation speed of a motor in a driving tool.

REPRESENTATIVE EMBODIMENT OF THE INVENTION

Figure 1:
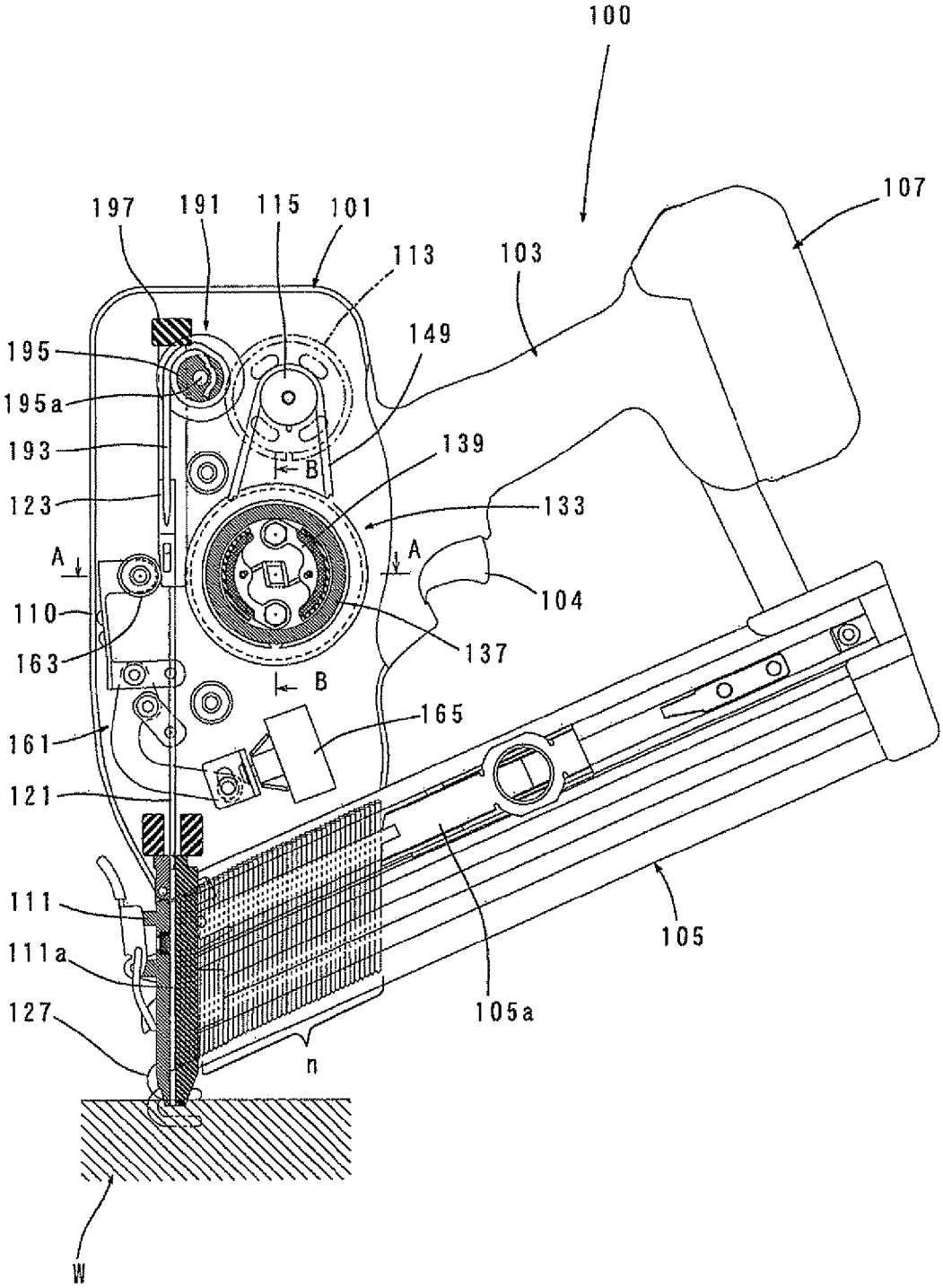
FIG. 1 is a side view showing an entire construction of a battery-powered nailing machine according to an embodiment of the invention.
Figure 2:
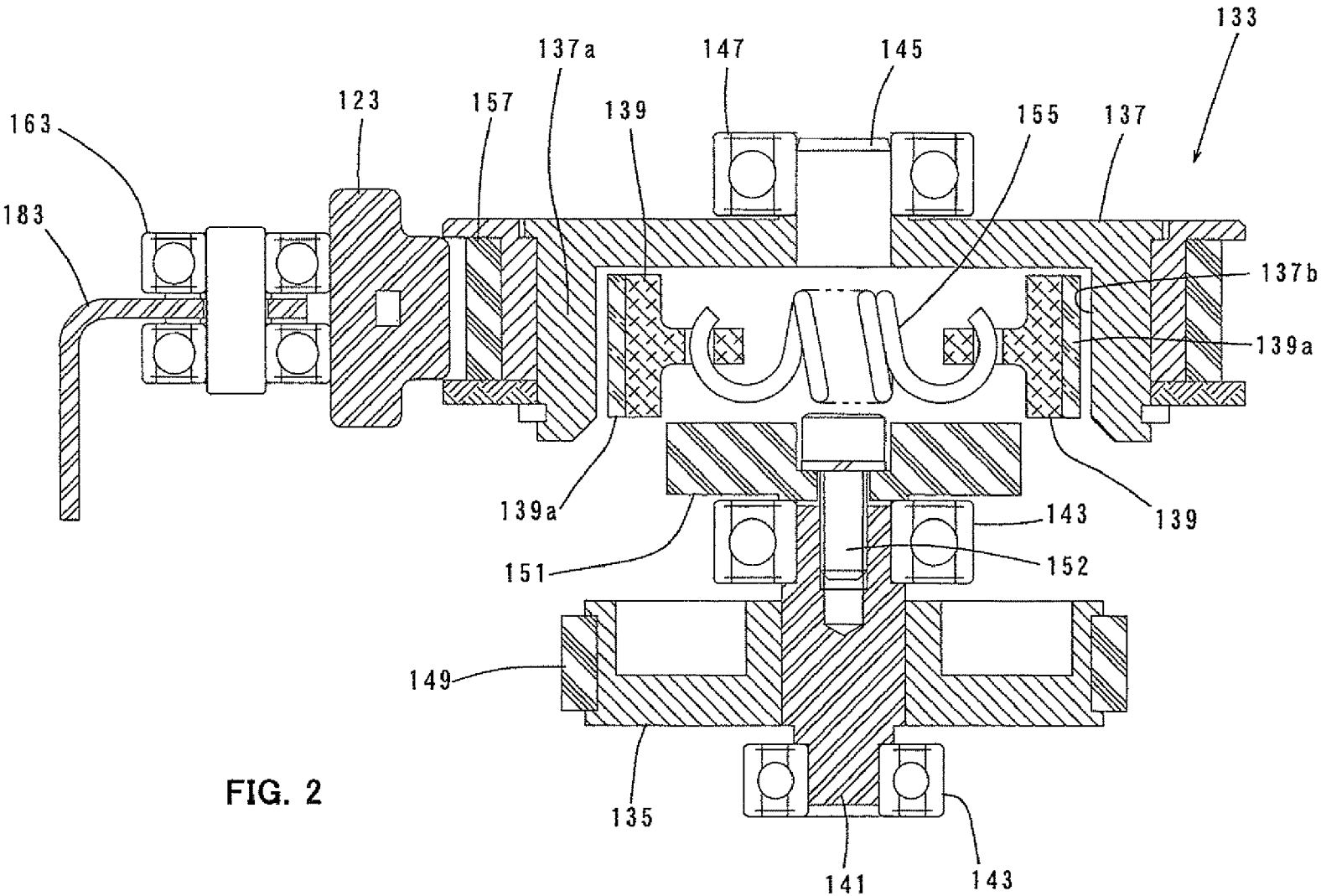
FIG. 2 is a sectional view taken along line A-A in FIG. 1, in a driver standby state in which a driver support is not yet pressed against a flywheel and in a power transmission interrupted state of a centrifugal clutch in which clutch shoes are disengaged from a wheel.
Figure 3:
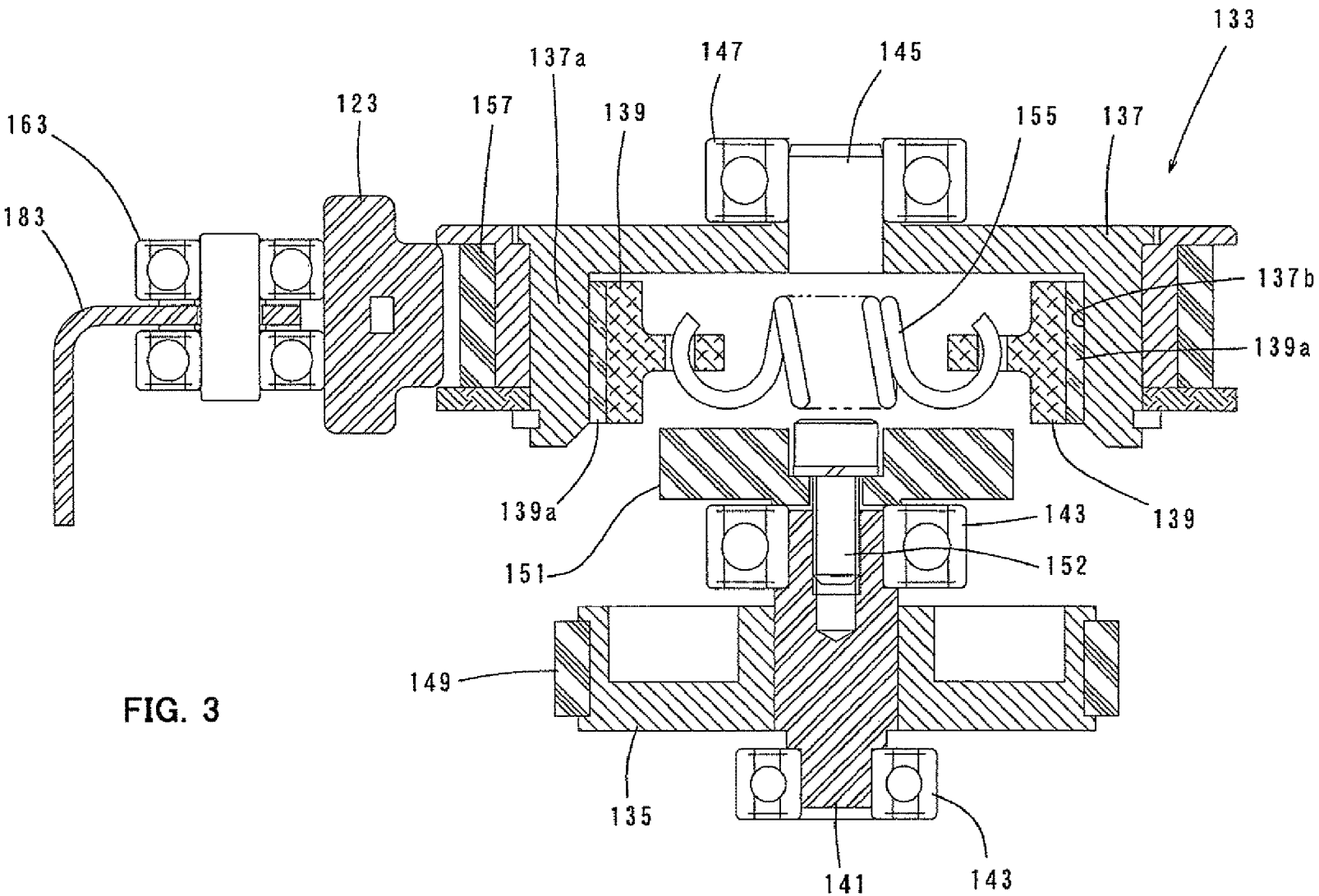
FIG. 3 is a sectional view taken along line A-A in FIG. 1, in the driver standby state in which the driver support is not yet pressed against the flywheel and in a power transmission state of the centrifugal clutch in which the clutch shoes are pressed against the wheel.
Figure 4:
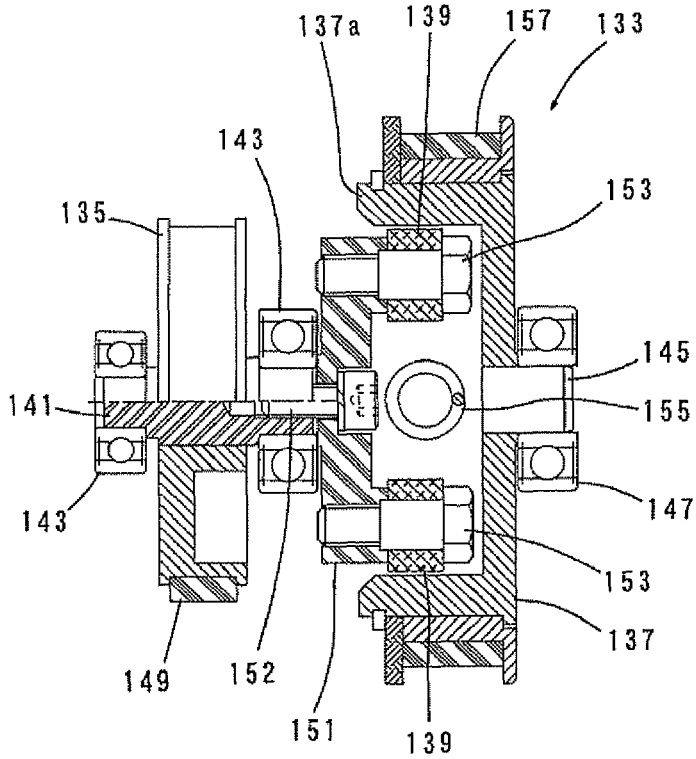
FIG. 4 is a sectional view taken along line B-B in FIG. 1.
Figure 5:
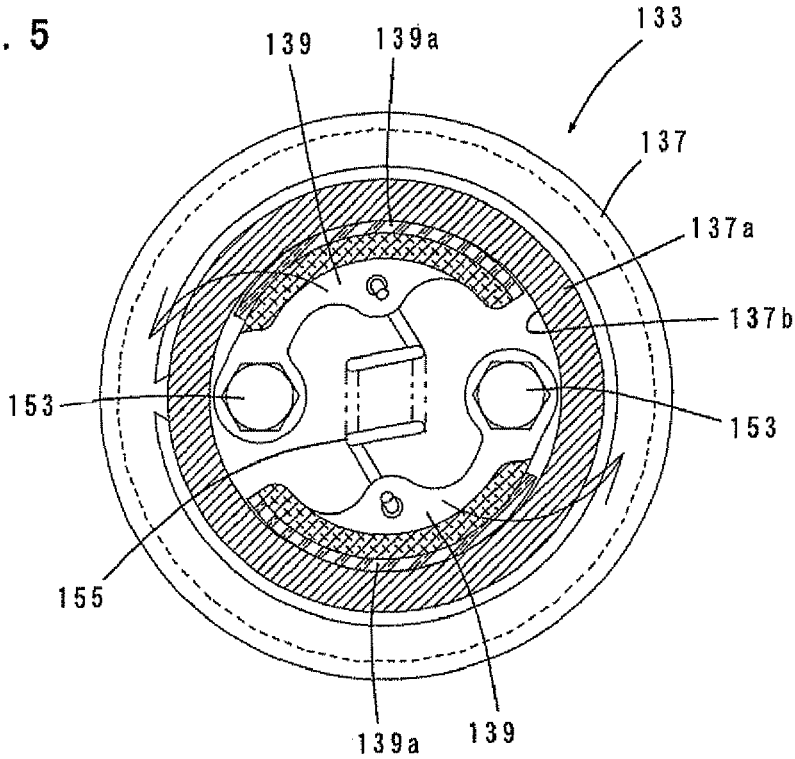
FIG. 5 is a front view showing the centrifugal clutch mounted to the flywheel, in the power transmission state in which the clutch shoes are pressed against the wheel.
Figure 6:
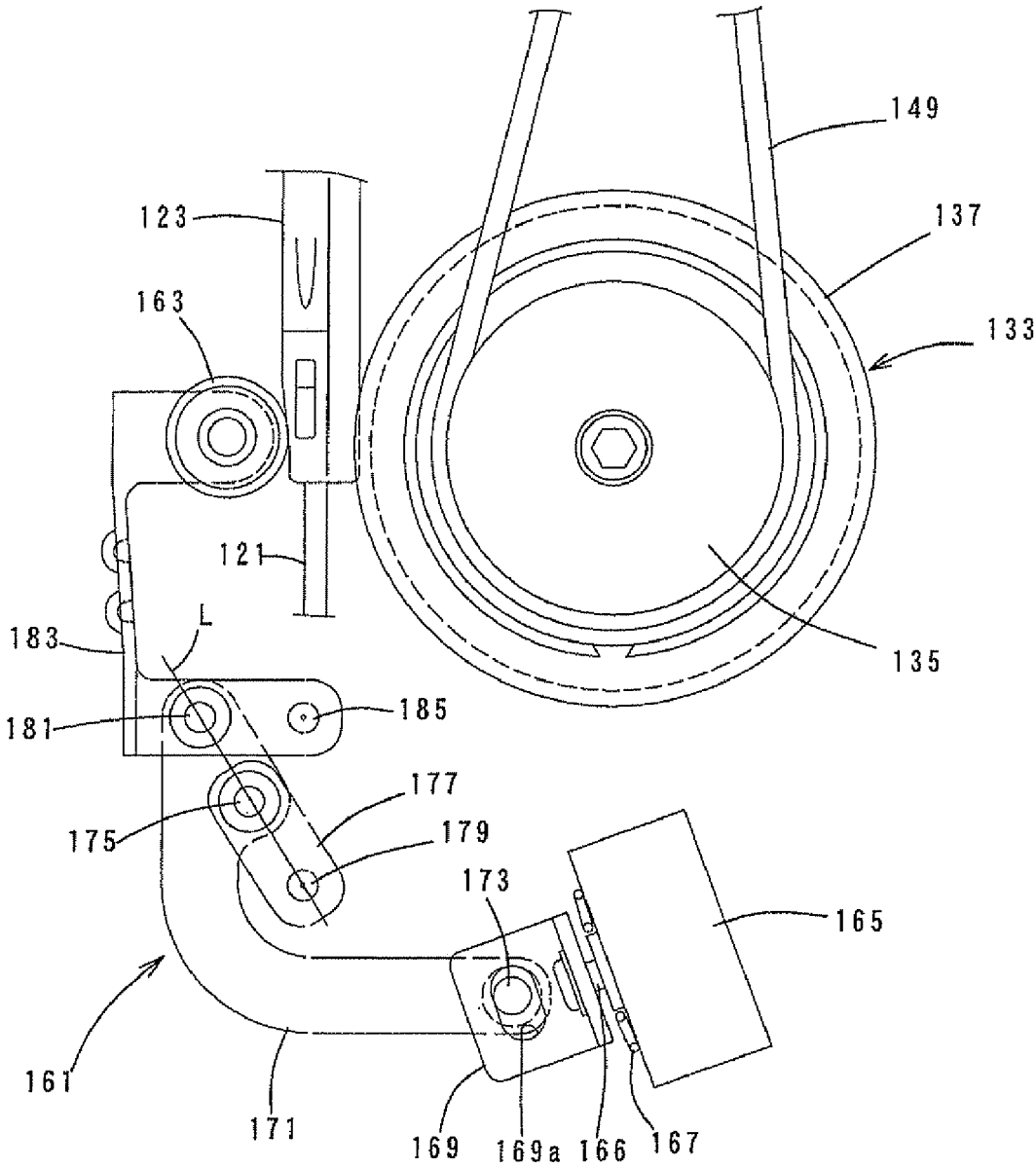
FIG. 6 is a side view showing a pressing mechanism for a driver.

An embodiment of the invention is now described with reference to the drawings. FIG. 1 shows an entire battery-powered nailing machine 100 as a representative example of a driving tool according to the embodiment of the invention. FIGS. 2 and 3 are sectional views taken along line A-A in FIG. 1, showing a driver driving section. FIG. 4 is a sectional view taken along line B-B in FIG. 1, showing the driver driving section. Further, FIG. 5 shows a centrifugal clutch mounted to a flywheel, and FIG. 6 shows a pressing mechanism that presses a driver against the flywheel.

As shown in FIG. 1, the nailing machine 100 includes a body 101 that forms an outer shell of the nailing machine 100, a handle 103 to be held by a user, and a magazine 105 that is loaded with nails n to be driven into a workpiece. The handle 103 is integrally formed with the body 101 and extends from the side of the body 101 in a lateral direction transverse to the longitudinal direction of the body 101 (the vertical direction as viewed in FIG. 1). A rechargeable battery pack 107 is mounted on the end of the handle 103, and a driving motor 113 is powered from the rechargeable battery pack 107. The driving motor 113 is a feature that corresponds to the "motor" according to the invention.

FIG. 1 shows the nailing machine 100 with the tip (lower end) of the body 101 pointed at a workpiece W. Therefore, a nail driving direction in which a nail n is driven (the longitudinal direction of the body 101) and a nail striking direction in which a driver 121 strikes the nail n are a downward direction in FIG. 1.

A driver guide 111 is provided on the tip (the lower end as viewed in FIG. 1) of the body 101 and forms a nail injection port. The magazine 105 is mounted to extend between the tip of the body 101 and the end of the handle 103, and the end of the magazine 105 on the nail feeding side is connected to the driver guide 111. The magazine 105 has a pressure plate 105*a* for pushing the nails n in the nail feeding direction (leftward as viewed in FIG. 1). The magazine 111 is designed such that the pressure plate 105*a* feeds the nails one by one into a nail injection hole 111*a* of the driver guide 111 from a direction transverse to the nail driving direction. The nail injection hole 111*a* is formed through the driver guide 111 in the nail driving direction. In this specification, the side of the driver guide 111 is taken as the front and its opposite side is taken as the rear.

The body 101 is generally cylindrically formed of resin and mainly includes a body housing 110 formed of two halves. The body housing 110 houses a driver 121 that reciprocates in a direction parallel to the nail driving direction and strikes the nail n, a flywheel 133 that is rotationally driven by the driving motor 113, a pressing mechanism 161 that presses a driver support 123 integrally formed with the driver 121 against the flywheel 133 by a pressure roller 163 so that the rotating force of the flywheel 133 is transmitted to the driver 121 as linear motion, and a return mechanism 191 that returns the driver 121 to a standby position (initial position) after completion of striking the nail. The standby position is the position to which the driver 121 is returned by the return mechanism 191 and contacts a stopper 197 located in the rear position (the upper position as viewed in FIG. 1) remotest from the driver guide 111.

A driver support 123 is provided generally in the center of the body housing 110 and formed of a rod-like metal material having a generally rectangular section and movable in a direction parallel to the nail driving direction via a slide support mechanism which is not shown. The driver 121 is joined to an end (lower end as viewed in FIG. 1) of the driver support 123 in the nail driving direction. The driver 121 is formed of a rod-like metal material having a generally rectangular section thinner than the driver support 123. The driver 121 extends toward the driver guide 111 and the tip of the driver 121 is located in the inlet (upper opening as viewed in FIG. 1) of the nail injection hole 111*a*. The driver 121 and the driver support 123 are features that correspond to the "operating member" according to the invention.

A driver driving mechanism includes a flywheel 133 that is rotationally driven at high speed by the driving motor 113, and a pressure roller 163 that presses the driver support 123 for supporting the driver 121 against the flywheel 133. As shown in FIGS. 2 and 3, the flywheel 133 and the pressure roller 163 can rotate on the axis that intersects with the nail driving direction and are disposed on opposite sides of the driver support 123. One side (hereinafter referred to as a "front surface") of the driver support 123 is located close to the outer circumferential surface of the flywheel 133. When the side of the driver support 123 opposite the front surface (hereinafter referred to as a "rear surface") is pressed against the outer circumferential surface of the flywheel 133 by the pressure roller 163, the driver support 123 is frictionally engaged with the flywheel 133 that rotates at high speed and thereby caused to move linearly in the nail driving direction.

FIGS. 2 and 3 show a standby state of the driver 121 in which the driver support 123 is not yet pressed against the flywheel 133. The flywheel 133 includes a pulley 135 that is rotationally driven by the driving motor 113, a wheel 137 and a clutch shoe 139 that transmits a rotating force of the pulley 135 to the wheel 137. The pulley 135, the wheel 137 and the clutch shoe 139 are features that correspond to the "driving-side member", the "driven-side member" and the "clutch member", respectively, according to the invention.

The pulley 135 and the wheel 137 are concentrically disposed. A rotary shaft 141 of the pulley 135 is rotatably supported by a bearing 143, and a rotary shaft 145 of the wheel 137 is rotatably supported by a bearing 147. The pulley 135 is rotationally driven via a driving belt 145 which is looped over the pulley 135 and the driving pulley 115 (see FIG. 1) mounted on an output shaft of the driving motor 113. The wheel 137 has a generally drum-like shape having a circular hollow internal space. A rotary disc 151 is fastened to the pulley 135 by a mounting bolt 152 and rotates together with the pulley 135. The rotary disc 151 is disposed to face the internal space of the wheel 137.

Two clutch shoes 139 are disposed inside an annular part 137*a* of the wheel 137. As shown in FIG. 5, a friction material (lining) 139*a* is placed on a surface of each of the clutch shoes 139 which faces an inner wall 137*b* of the annular part 137*a*. The clutch shoe 139 has a generally semicircular ring-like shape extending in the circumferential direction of the annular part 137*a*. One end of the clutch shoe 139 in the circumferential direction is mounted to the rotary disc 151 via a mounting shaft 153 such that it can pivot in the radial direction (see FIG. 4). When the pulley 135 (the rotary disc 151) rotates, the clutch shoe 139 pivots outward by centrifugal force acting upon the clutch shoe 139. Then the outer surface of the clutch shoe 139 is pressed against the inner wall 137*b* of the annular part 137*a* of the wheel 137. As a result, the pulley 135 and the wheel 137 are connected and the rotating force of the pulley 135 is transmitted to the wheel 137.

A tension coil spring 155 is mounted between the two clutch shoes 139 and serves as a biasing member for biasing the clutch shoes 139 in a direction that moves (disengages) the clutch shoes 139 away from the inner wall 137*b* of the wheel 137. Therefore, the pulley 135 and the wheel 137 are connected by the clutch shoes 139 against the biasing force of the tension coil spring 155. Specifically, the spring force of the tension coil spring 155 is set such that the pulley 135 and the wheel 137 are connected by the clutch shoes 139 when the rotation speed of the pulley 135 (the rotation speed of the driving motor 113) is increased to a predetermined speed or higher at which a striping force required for driving a nail n can be secured, while the connection between the pulley 135 and the wheel 137 is released when the rotation speed of the pulley 135 is lower than the predetermined speed. The clutch shoes 139, the wheel 137 and the tension coil spring 155 form the centrifugal clutch.

As shown in FIGS. 2 and 3, the wheel 137 is formed as a double-layered wheel assembly having concentrically disposed inner and outer wheels, which is not directly related to the invention and is not therefore described.

As shown in FIGS. 2 and 3, the wheel 137 having the above-described construction is disposed such that an outer circumferential surface of a rubber ring 157 fitted on a rim of the wheel 137 faces a front surface of the driver support 123. The rubber ring 157 has the outer circumferential surface parallel to the axis of the wheel 137, and in the standby state of the driver 121, the outer circumferential surface of the rubber ring 157 faces the front surface of the driver support 123 in parallel with a slight clearance therebetween.

Next, the pressing mechanism 161 is described with reference to FIG. 6. The pressing mechanism 161 has an electromagnetic actuator 165 disposed in a front part (lower part as viewed in FIG. 1) within the body housing 110. An output shaft 166 of the electromagnetic actuator 165 is biased toward a protruded position by a compression spring 167. When the electromagnetic actuator 165 is energized, the output shaft 166 moves toward a retracted position against the biasing force of the compression spring 167. When the electromagnetic actuator 165 is de-energized, the output shaft 166 is returned to the protruded position by the compression spring 167.

One end of an actuating arm 171 is connected to the end of the output shaft 166 of the electromagnetic actuator 165 for relative rotation via a bracket 169. A connecting hole 169*a* is formed in the bracket 169 and elongated in a direction perpendicular to the direction of movement of the output shaft 166. The actuating arm 171 is connected to the bracket 169 via a connecting shaft 173 inserted through the connecting hole 169*a*. Therefore, the one end of the actuating arm 171 is connected to the bracket 169 such that it can rotate via the connecting shaft 173 and such that the center of rotation of the actuating arm 171 can be displaced within the range in which the connecting shaft 173 serving as the center of the rotation can move within the connecting hole 169*a*.

The actuating arm 171 is bent in an L-shape and extends rearward (upward as viewed in FIGS. 1 and 6). One end of a control arm 177 is rotatably connected to the other end of the actuating arm 171 via a first movable shaft 175. The control arm 177 is rotatably connected to the body housing 110 via a first fixed shaft 179. Further, the other end of the actuating arm 171 is rotatably connected to a pressure arm 183 via a second movable shaft 181. The pressure arm 183 is rotatably supported by the body housing 110 via a second fixed shaft 185. The pressure roller 163 is rotatably supported on the rotating end (the upper end as viewed in FIGS. 1 and 6) of the pressure arm 183.

In the pressing mechanism 161 thus constructed, in the standby state shown in FIG. 1, the electromagnetic actuator 165 is de-energized and thus the output shaft 166 is returned to the protruded position by the compression spring 167. In this standby state, the proximal end (on the side of the connecting shaft 173) of the actuating arm 171 is displaced obliquely downward right as viewed in FIG. 1. Therefore, the control arm 177 rotates on the first fixed shaft 179, so that the pressure roller 163 cannot press (is disengaged from) the back of the driver support 123. As a result, the front surface of the driver support 123 is disengaged from the outer circumferential surface of the rubber ring 157 of the wheel 137. This state is shown in FIGS. 2 and 3.

When the electromagnetic actuator 165 is energized, the output shaft 166 is moved to the retracted position against the biasing force of the compression spring 167. At this time, the proximal end of the actuating arm 171 is moved obliquely upward left. Then, the control arm 177 rotates clockwise on the first fixed shaft 179, and the pressure arm 183 rotates clockwise on the second fixed shaft 185. Therefore, the pressure roller 163 presses the back of the driver support 123 and thereby presses the front surface of the driver support 123 against the rubber ring 157 of the wheel 137. At this time, the first fixed shaft 179 of the control arm 177, the first movable shaft 175 serving as a connecting point between the control arm 177 and the actuating arm 171, and the second movable shaft 181 serving as a connecting point between the actuating arm 171 and the pressure arm 183 lie on a line L. This state is shown in FIG. 6. Thus, the pressure arm 183 is locked in the state in which the driver support 123 is pressed against the wheel 137 of the flywheel 133 by the pressure roller 163. Specifically, the pressing mechanism 161 locks the pressure roller 163 in the pressed position by means of a toggle mechanism which is formed by the first fixed shaft 179, the first movable shaft 175 and the second movable shaft 181. In this manner, the pressing mechanism 161 serves to hold the driver support 123 pressed against the rubber ring 157 of the wheel 137. When the driver support 123 is pressed against the rubber ring 157 of the wheel 137 rotating at high speed, the driver 121 is caused to move at high speed toward the driver guide 111 together with the driver support 123 by the rotational energy of the flywheel 133. The driver 121 then strikes the nail n and drives it into the workpiece.

Next, the return mechanism 191 that returns the driver 121 to the standby position after completion of driving the nail n into the workpiece is now explained with reference to FIG. 1. The return mechanism 191 mainly includes right and left string-like elastic return rubbers 193 for returning the driver 121, right and left winding wheels 195 for winding the return rubbers 193, and a flat spiral spring (not shown) for rotating the winding wheels 195 in the winding direction. The right and left winding wheels 195 are disposed in a rear region (upper region as viewed in FIG. 1) of the body housing 110 and rotate together with one winding shaft 195*a* rotatably supported by a bearing. The flat spiral spring is disposed on the winding shaft 195*a*. One end of the flat spiral spring is anchored to the body housing 110, and the other end is anchored to the winding shaft 195*a*. The flat spiral spring biases the winding wheels 195 in the winding direction together with the winding shaft 195*a*. One end of each of the right and left return rubbers 193 is anchored to the associated right or left winding wheel 195, and the other end is anchored to the associated side surface of the driver support 123. The driver 121 is pulled by the return rubber 193 together with the driver support 123 and retained in the standby position in contact with the stopper 197.

A contact arm 127 is provided on the driver guide 111 and actuated to turn on and off a contact arm switch (not shown) for energizing and de-energizing the driving motor 113. The contact arm 127 is mounted movably in the longitudinal direction of the driver guide 111 (the longitudinal direction of the nail n) and biased in such a manner as to protrude from the tip end of the driver guide 111 by a spring which is not shown. When the contact arm 127 is in the protruded position (shown by two-dot chain line in FIG. 1), the contact arm switch is in the off position, while, when the contact arm 127 is moved toward the body housing 110, the contact arm switch is placed in the on position. Further, a trigger 104 is provided on the handle 103 and designed to be depressed by the user and returned to its initial position by releasing the trigger. When the trigger 104 is depressed, a trigger switch (not shown) is turned on and the electromagnetic actuator 165 of the pressing mechanism 161 is energized. When the trigger 104 is released, the trigger switch is turned off and the electromagnetic actuator 165 is de-energized. The trigger 104 and the pressing mechanism 161 are features that correspond to the "operating member actuation mechanism" according to the invention.

Operation and usage of the nailing machine 100 constructed as described above is now explained. When the user holds the handle 103 and presses the contact arm 127 against the workpiece, the contact arm 127 is pushed by the workpiece and retracts toward the body housing 110. Thus, the contact arm switch is turned on and the driving motor 113 is energized. The rotational output of the driving motor 113 is transmitted to the pulley 135 of the flywheel 133 via the driving pulley 115 and the driving belt 149, and then the clutch shoes 139 rotate together with the pulley 135 and the rotary disc 151. When the rotation speed of the pulley 135 increases and exceeds a predetermined speed, the clutch shoes 139 pivot outward against the biasing force of the tension coil spring 155 by centrifugal force, and the friction material (lining) 139*a* is pressed against the inner wall 137*b* of the annular part 137*a* of the wheel 137. Thus, the pulley 135 and the wheel 137 are connected and the wheel 137 rotates together with the pulley 135.

In this state, when the trigger 104 is depressed, the trigger switch is turned on and the electromagnetic actuator 165 is energized, so that the output shaft 166 is retracted. As a result, the actuating arm 171 is displaced, and the pressure arm 183 rotates on the second fixed shaft 185 in the pressing direction and presses the back of the driver support 123 with the pressure roller 163. The driver support 123 pressed by the pressure roller 163 is pressed against the rubber ring 157 forming the outer circumferential surface of the wheel 137. Therefore, the driver 121 is caused to move linearly in the nail driving direction together with the driver support 123 by the rotating force of the wheel 137. The driver 121 then strikes the nail n with its tip and drives it into the workpiece. At this time, the return rubber 193 is wound off the winding wheel 195 and the flat spiral spring 195*b* is wound up.

When the trigger 104 is released after completion of driving the nail n by the driver 121, the electromagnetic actuator 165 is de-energized. As a result, the output shaft 166 of the electromagnetic actuator 165 is returned to the protruded position by the compression spring 167, and thus the actuating arm 171 is displaced. When the actuating arm 171 is displaced, the first movable shaft 175 is displaced off the line connecting the first fixed shaft 179 and the second movable shaft 181, so that the toggle mechanism is released. Further, the pressure arm 183 is caused to rotate counterclockwise on the second fixed shaft 185, so that the pressure roller 163 is disengaged from the driver support 123. Upon disengagement of the pressure roller 163, the driver support 123 is pulled by the return rubber 193 and returned to the standby position in contact with the stopper 197 as shown in FIG. 1. The return rubber 193 has its own elasticity in its contracting direction, and it is wound up by the winding wheel 195 spring-biased in the winding direction. Therefore, even if the driver support 123 is moved in a large stroke in the nail driving direction, the driver support 123 can be reliably returned to its standby position. Further, permanent set of the return rubber 193 in fatigue can be reduced, so that the durability can be enhanced.

As described above, in this embodiment, when the driving motor 113 is rotationally driven by pressing the contact arm 127 against the workpiece W, the clutch shoes 139 are held in a position toward the central axis apart from the inner wall 137*b* of the wheel 137 until the rotation speed of the driving motor 113 reaches a predetermined speed. When the rotation speed of the pulley 135 exceeds a predetermined speed, the clutch shoes 139 are pressed against the inner wall 137*b* of the wheel 137 against the biasing force of the tension coil spring 155 by centrifugal force acting upon the clutch shoes 139. Thus, the pulley 135 and the wheel 137 are connected and the wheel 137 rotates together with the pulley 135.

Specifically, in this embodiment, the flywheel 133 is not driven unless the rotation speed of the driving motor 113 increases to a speed at which the flywheel 133 can be driven at high speed in order to obtain inertial energy (striking force) required for driving a nail n. Therefore, for example, when the battery level for the driving motor 113 is low and the rotation speed of the driving motor 113 is lower than the predetermined speed, or when the striking force is not strong enough, the nail driving movement by the flywheel 133 can be disabled, so that faulty nail driving can be prevented.

Further, in this embodiment, with the construction in which the pulley 135 and the wheel 137 are connected via the clutch shoes 139 when the rotation speed of the driving motor 113 reaches the predetermined speed, a slight time lag can be created between the starting time of the driving motor 113 and the driving time of the flywheel 133 or the connecting time of the pulley 135 and the wheel 137. Therefore, the maximum starting current at the time of starting the driving motor 113 can be minimized. In other words, a voltage drop upon starting can be reduced. As a result, problems which may be caused by the voltage drop, such as that the rise time upon starting gets longer, or that the voltage drop adversely affects the battery life, can be solved.

As a solution to the problem of faulty nail driving due to an inadequate rotation speed of the driving motor 113, for example, a means for detecting the remaining battery level or a means for detecting the voltage of the driving motor 113 may be provided. Based on this detection, it may be determined whether the flywheel 133 can be operated at high speed at which a predetermined striking force can be exerted. Only if yes, the driver 121 may be driven by the flywheel 133. With such construction, however, a large number of components are required, so that the structure is complicated or the cost is increased. According to this embodiment, the pulley 135 and the wheel 137 are mechanically (automatically) connected and disconnected. Therefore, such a construction is advantageous in structural simplification and cost reduction, compared with a mechanism formed by the above-mentioned detecting means and determining means.

Further, in this embodiment, the battery-powered nailing machine 100 is described as an example of the driving tool, but the invention is not limited to a battery-powered driving tool, but it can be applied to any electric driving tool of the type in which the driver 121 is linearly driven in the nail driving direction by utilizing the inertial energy of the flywheel 133.

DESCRIPTION OF NUMERALS

100 nailing machine (driving tool)
101 body
103 handle
104 trigger
105 magazine
105*a* pressure plate
107 battery pack
110 body housing
111 driver guide
111*a* nail injection hole
113 driving motor
115 driving pulley
121 driver
123 driver support
127 contact arm
133 flywheel
135 pulley (driving-side member)
137 wheel (driven-side member)
137*a* annular part
137*b* inner wall
139 clutch shoe (clutch member)
139*a* friction material
141 rotary shaft
143 bearing
145 rotary shaft
147 bearing
149 driving belt
151 rotary disc
152 mounting bolt
153 mounting shaft
155 tension coil spring
157 rubber ring
161 pressing mechanism
163 pressure roller
165 electromagnetic actuator

166 output shaft
167 compression spring
169 bracket
169*a* connecting hole
171 actuating arm
173 connecting shaft
175 first movable shaft
177 control arm
179 first fixed shaft
181 second movable shaft
183 pressure arm
185 second fixed shaft
191 return mechanism
193 return rubber
195 winding wheel
195*a* winding shaft
197 stopper

The invention claimed is:

1. A driving tool comprising:

a motor, a flywheel that is rotationally driven by the motor, an operating member that drives a material to be driven, an operating member actuation mechanism that selectively transmits a rotating force of the flywheel to the operating member and drives the operating member, wherein the flywheel includes a driving-side member that is rotationally driven by the motor, a driven-side member that transmits a rotating force to the operating member, and a clutch member that connects the driving-side member and the driven-side member when the rotation speed of the motor is a predetermined speed or higher, while releasing the connection between the driving-side member and the driven-side member when the rotation speed of the motor is lower than the predetermined speed.

2. The driving tool according to claim 1, wherein the clutch member includes a clutch shoe that rotates together with the driving-side member, and an elastic element that biases the clutch shoe in a direction that moves the clutch shoe away from the driven-side member and when the rotation speed of the motor is lower than the predetermined speed, the clutch shoe is disengaged from the driven-side member by a biasing force of the elastic element, so that the connection between the driving-side member and the driven-side member is released and when the rotation speed of the motor is a predetermined speed or higher, the clutch shoe is engaged with the driven-side member against the biasing force of the elastic element by a centrifugal force acting upon the clutch shoe, so that the driving-side member and the driven-side member are connected.

3. The driving tool according to claim 2, wherein the driving-side member and the driven-side member include a pulley and a wheel, respectively, which are concentrically disposed.

4. The driving tool according to claim 1, wherein the driving-side member and the driven-side member include a pulley and a wheel, respectively, which are concentrically disposed.

* * * * *